US006487901B1

(12) United States Patent
Keyes

(10) Patent No.: US 6,487,901 B1
(45) Date of Patent: Dec. 3, 2002

(54) TRANSMITTER HOUSING FOR PROBE IN A DIRECTIONAL UNDERGROUND DRILLING APPARATUS

(76) Inventor: Robert C. Keyes, 3205 Bark Conners Dr., Norman, OK (US) 73070

( * ) Notice: Subject to any disclaimer, the term of this patent is extended or adjusted under 35 U.S.C. 154(b) by 0 days.

(21) Appl. No.: 09/473,212

(22) Filed: Dec. 27, 1999

Related U.S. Application Data

(60) Provisional application No. 60/114,202, filed on Dec. 28, 1998.

(51) Int. Cl.[7] ..... E21B 47/00
(52) U.S. Cl. ..... 73/152.46
(58) Field of Search ..... 73/866.5, 152.01, 73/152.43–152.46; 175/45, 61, 73; 340/853.1, 853.3–853.6

(56) References Cited

U.S. PATENT DOCUMENTS 4,181,014 A * 1/1980 Zuvela et al. ..... 73/152.46
5,397,893 A * 3/1995 Minette
5,934,391 A * 8/1999 Cox
5,950,743 A * 9/1999 Cox
6,050,350 A * 4/2000 Morris et al.

* cited by examiner

*Primary Examiner*—Robert Raevis
(74) *Attorney, Agent, or Firm*—Fellers, Snider, et al.; Bill D. McCarthy

(57) ABSTRACT

A transmitter housing apparatus for the containment of a probe in a directional underground drilling device, the transmitter housing having a housing with first and second ends and a longitudinally extending bore for receiving the probe, the housing having a first detent near the first end. A cover member is slidingly engaged by the first by the first detent to cover the bore and to secure the probe in the housing. A sub member engages the second end of the housing to secure the cover member on the housing. A positioning member is disposed in the bore and engages the probe for rotationally positioning the probe in a desired orientation in the bore of the housing. A plurality of slots or the like are provided in the housing for selectively orienting the probe. Also, the housing has a passageway for fluid flow, and has a plurality of slots to permit signal transmission by the probe.

18 Claims, 5 Drawing Sheets

TRANSMITTER HOUSING FOR PROBE IN A DIRECTIONAL UNDERGROUND DRILLING APPARATUS

RELATED APPLICATION

This application claims priority to Provisional Application No. 60/114,202 entitled "Housing For Supporting A Transmitting Probe In A Directional Underground Drilling Apparatus" and filed Dec. 28, 1998.

FIELD OF THE INVENTION

This invention relates generally to the field of subterranean horizontal and directional drilling, and more particularly, but not by way of limitation, to a transmitter housing for supporting a transmitting probe or sonde used to steer and direct a drilling apparatus.

BACKGROUND

Recent advances in directional underground drilling offers significant advantages over earlier methods in a number of applications. Underground directional drilling eliminates the need for trenching and backfilling in laying pipeline and other utilities. Underground directional drilling furthermore provides greater flexibility and increased opportunities for subterranean drilling, such as in the drilling for subterranean fluids and in core sampling.

Many differing approaches have been undertaken in the development of underground directional drilling. Generally, a cutting tool is advanced at a distal end of a drill string. A drilling fluid, such as water, is flowed through the drill string, over the cutting tool, and back up the bore hole in order to remove cuttings and debris as the bore is created. A transmitting probe typically is employed in the drill string near the cutting tool in order to monitor the location of the cutting tool, and to steer and direct the cutting tool.

The type of transmitting probe employed varies, depending on the nature of the boring environment and the relative boring accuracy needed. U.S. Pat. No. 4,787,463 issued to Geller, for example, teaches the use of an active beam radio transmitter in conjunction with a tracking receiver above ground. Alternatively, U.S. Pat. No. 5,720,354 issued to Stump teaches a ground penetrating radar unit wherein the transmitter generates a specific signature signal in response to a probe signal from the radar unit above ground.

The type of cutting action employed also varies. U.S. Pat. No. 4,144,941 issued to Ritter teaches the widely used impact method for directional tunneling. Numerous improvements to this early teaching have been made in the art, such as provided in the hammering method of directional drilling wherein the cutting head is not rotated, such as is taught in U.S. Pat. No. 4,694,913 issued to McDonald, and U.S. Pat. No. 5,109,932 issued to Breter.

Where these general advancements in the art generally require the support of a transmitter near the impact-cutting head of the drilling apparatus, such a requirement presents challenging difficulties. The rotational and axial position of the transmitter must be provided for and maintained, without damaging the relatively delicate transmitter. Conventional fasteners, also, have demonstrated the propensity to vibrate loose during the repeated impact cycles of hammering, resulting in erroneous readings, as well as lost and damaged transmitters.

There is a need in the industry for a transmitter housing that is disposable in the drill string and that, in turn, receivingly supports a conventional transmitting probe in a reliable manner, not relying on conventional fasteners such as threaded screws to support or enclose the transmitting probe.

SUMMARY OF THE INVENTION

The present invention provides a transmitter housing for the containment of a probe in a directional underground drilling device, the transmitter housing having a housing with first and second ends and a longitudinally extending bore for receiving the probe, the housing having a first detent near the first end. A cover member is slidingly engaged by the first by the first detent to cover the bore and to secure the probe in the housing. A sub member engages the second end of the housing to secure the cover member on the housing.

A positioning member is disposed in the bore and engages the probe for rotationally positioning the probe in a desired orientation in the bore of the housing. Preferably, the housing has a plurality of slots or the like for selectively orienting the probe.

The housing has a passageway for fluid flow, and has a plurality of slots to permit the signal transmission.

The objects, features and advantages of the present invention will be clear upon reading the description provided together with the drawings and appended claims.

BRIEF DESCRIPTION OF THE DRAWINGS

FIG. 6 is a top view of the cover portion of the transmitter housing assembly of FIG. 1.

FIG. 16 is a partial sectional view of the housing portion of the transmitter housing assembly of FIG. 1.

DETAILED DESCRIPTION

Figure 1:
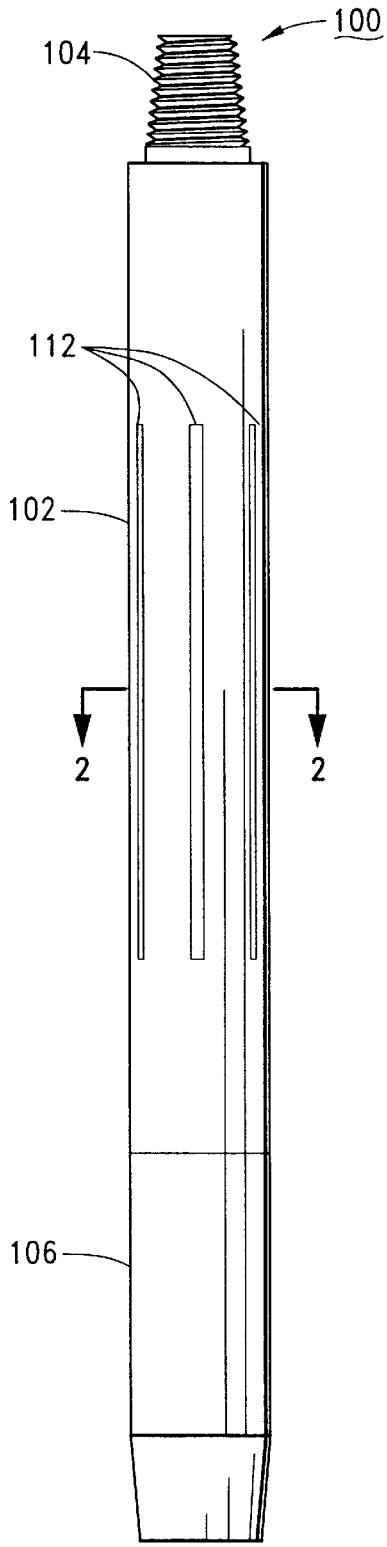
FIG. 1 is an elevational view of a transmitter housing assembly constructed in accordance with the present invention.

Referring to the drawings in general, and in particular to FIG. 1, shown therein is an elevational view of a transmitter housing assembly 100 constructed in accordance with a preferred embodiment of the present invention. While examples of disclosure are provided herein for reference, such are for purposes of illustration and are not limiting to the scope of the present invention.

The transmitter housing assembly 100 generally has a housing 102 that is connectable at one end to a drill string (not shown) and at its other end to any one of various selected drilling tools (not shown). In the embodiment illustrated in FIG. 1, one end of the transmitter housing assembly 100 has a threaded end 104 for connection to a mud motor or to a selected drilling tool, and the other end has a locking sub 106 for connection to the drill string.

Figure 2:
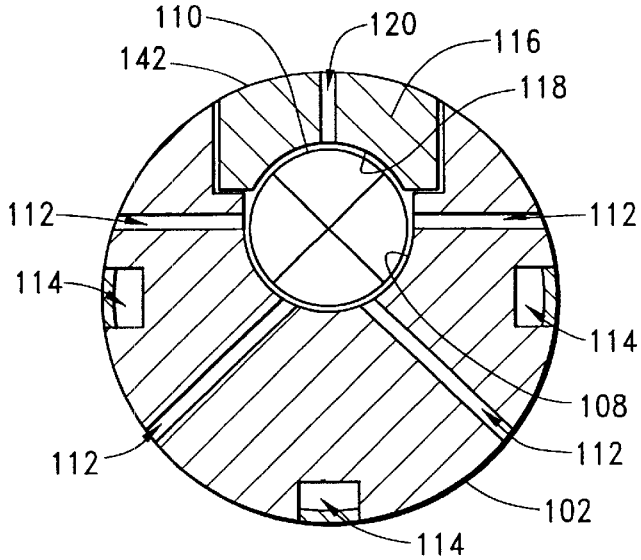
FIG. 2 is a sectional view taken along the line 2—2 of FIG. 1.

Turning to the sectional view of FIG. 2, the housing 102 has a longitudinal cavity 108 for receiving a conventional transmitting device or probe in the manner widely used in the drilling field to steer and direct a cutting tool during drilling operations. The transmitter or probe type varies, but for purposes of the present invention the type of transmitter or probe is widely known, and as such a detailed description will not be necessary for an understanding of the invention at hand. Rather, it will be sufficient to note that the transmitter or probe is commonly more generally referred to as a sonde 110.

The housing 102 has a number of laterally extending slots 112 that provide transmission channels for passage of the signals from the sonde 110 to the subterranean environment. The housing 102 also has a number of longitudinal passageways 114 to provide a water jacket for circulating drilling fluids to the mud motor or other selected drilling tool a during drilling operation.

A locking cover 116 is provided for closing the cavity 108 and thus to enclose the housing 102 to retain the sonde 110 therein. The locking cover 116 has an arcuate surface 118 that matingly cooperates with the cavity 108 to support the sonde 110, and the locking cover 116 has a slot 120 that serves the same function as that of the signal transmission slots 112 described above. That is, the laterally extending slot 120 that provides a transmission channel for passage of signals from the sonde 110 to the subterranean environment. The manner in which the sonde 110 is positionally supported within the housing 102 is addressed by the present invention below.

Figure 3:
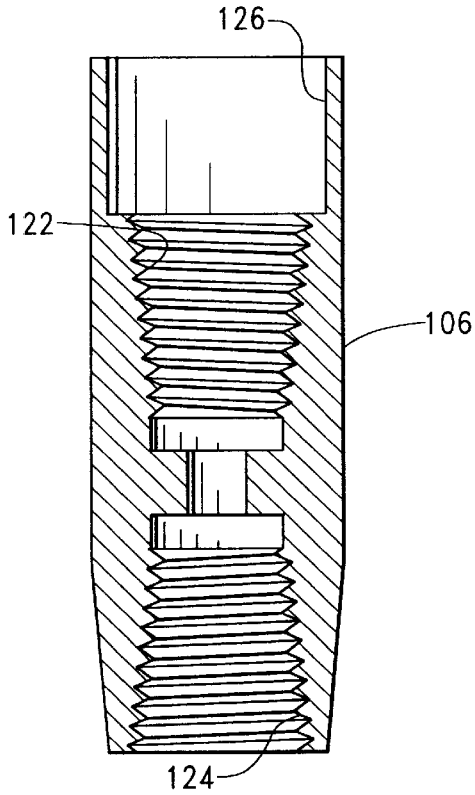
FIG. 3 is a sectional view of the locking sub portion of the transmitter housing assembly of FIG. 1.

FIG. 3 illustrates in cross-section the locking sub 106 which in a preferred embodiment has a first threaded portion 122 which threadingly engages the housing 102, and a second threaded portion 124 which threadingly engages the supporting drill string. Adjacent the first threaded portion 122 is a counterbore 126 which cooperates in the retention of the locking cover 116 in place, as described fully below.

Figure 4:
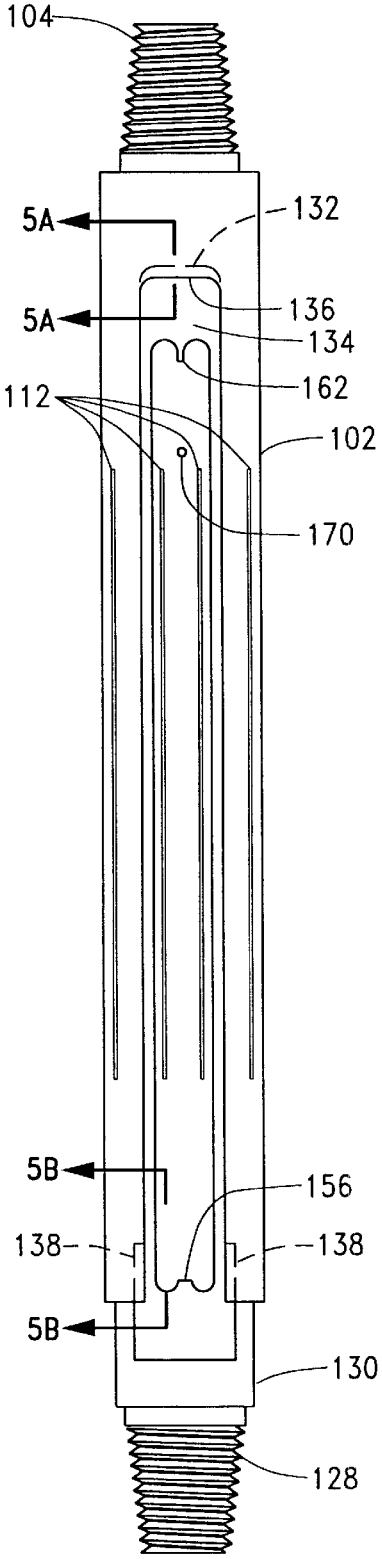
FIG. 4 is an elevational view of the transmitter housing assembly of FIG. 1 with the locking sub and cover removed.

FIG. 4 is a view of the opposing side of the housing 102. The locking sub 106, the locking cover 116 and the sonde 110 are not shown in FIG. 4 in order to more clearly illustrate the features of the housing 102. FIG. 4 thus shows that the housing 102 has a threaded end 128 that is received within, and threadingly engages, the first threaded portion 122 of the locking sub 106. When the locking sub 106 is thus threadingly attached to the housing 102, the counterbore 126 forms a closely fitting relationship with an outer diameter 130, and in doing so, retains a portion of the locking cover 116 as described below.

Figure 5A:
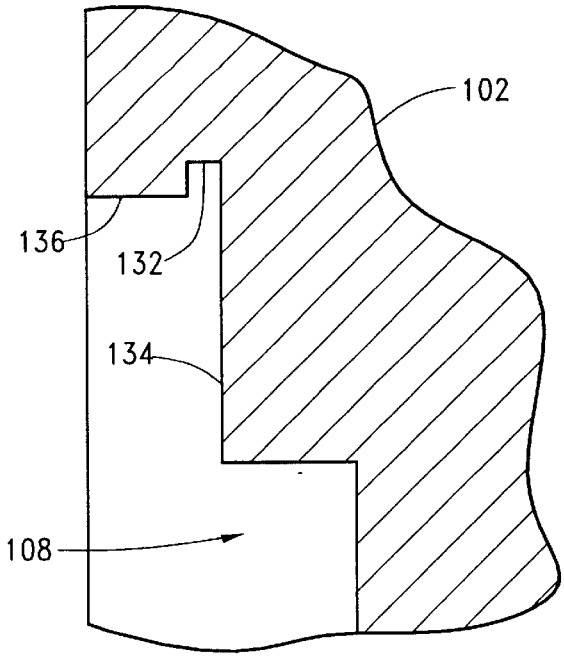
FIG. 5A is a sectional detail taken along the line 5A—5A of FIG. 4.
Figure 5B:
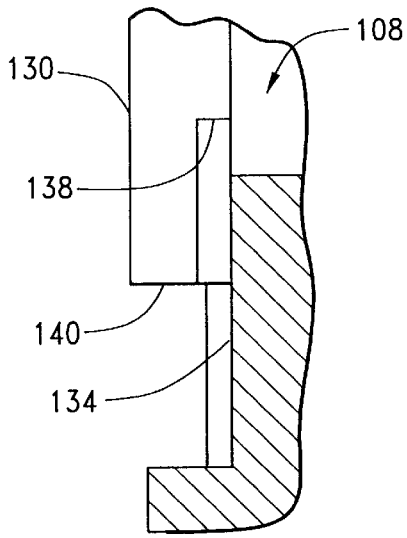
FIG. 5B is a sectional detail taken along the line 5B—5B of FIG. 4.
Figures 7, 8:
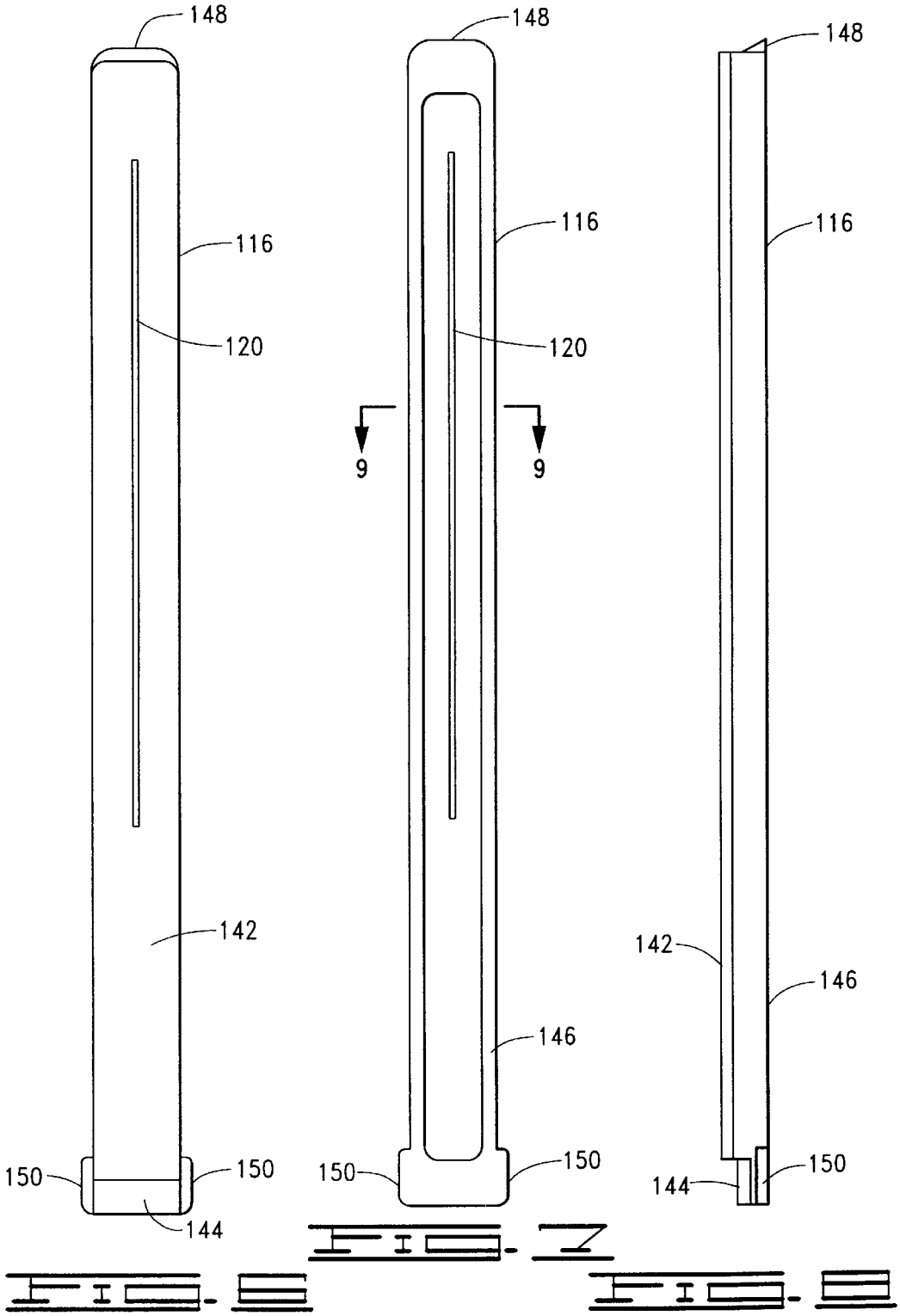
FIG. 7 is a bottom view of the cover portion of FIG. 6.
FIG. 8 is a side view of the cover portion of FIG. 6.
Figure 9:
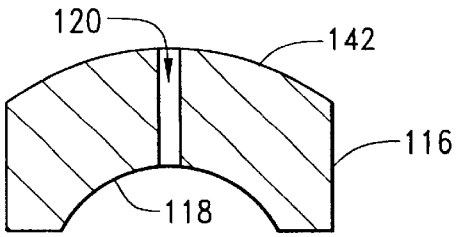
FIG. 9 is a sectional view of the cover portion taken along the line 9—9 of FIG. 7.

FIG. 5A illustrates a detent 132 formed between a longitudinal surface 134 and an orthogonal projecting surface 136 of the housing 102. An upper end portion of the locking cover 116 is lockingly engaged in the detent 132, as described more fully below. FIG. 5B illustrates one of a pair of detents 138 formed between the longitudinal surface 134 and an orthogonal projecting surface 140 on the housing 102. A lower end portion of the locking cover 116 is lockingly retained in the detents 138, as described more fully below.

The locking cover 116 depicted in FIGS. 6 through 9 forms two arcuate surfaces of different radii, such that when the locking cover 116 is positioned on the housing 102 (see the cross-section view of FIG. 2), a first radius 142 matingly aligns with, and is contiguous to, the outer diameter of the housing 102, and a second radius 144 is matingly aligned with, and is contiguous to, the outer diameter 130 (see FIG. 6).

When positioned on the housing 102, the locking cover 116 is disposed so that a sliding surface 146 thereof is supported on the longitudinal surface 134 of the housing 102. The locking cover 116 is then slidingly displaced toward the threaded end 104 of the housing 102 to engage an upper tab 148 of the locking cover 116 into the detent 132, and simultaneously to engage a pair of lower tabs 150 of the locking cover 116 into the detents 138. The locking cover 116 is thus lockingly engaged in the housing 102 to support the sonde 110 without the use of fasteners. The locking cover 116 is retained in this locking engagement by attaching the locking sub 106 to the housing 102, with the counterbore 126 providing a close fitting relationship about the diameter 130 of the housing 102 and the radius 144 of the locking cover 116.

Figure 10:
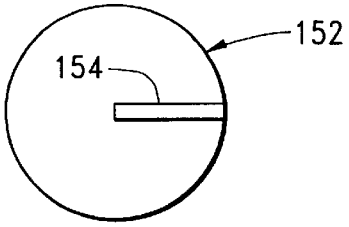
FIG. 10 is a view of one end of a rotary positioner.
Figure 11:
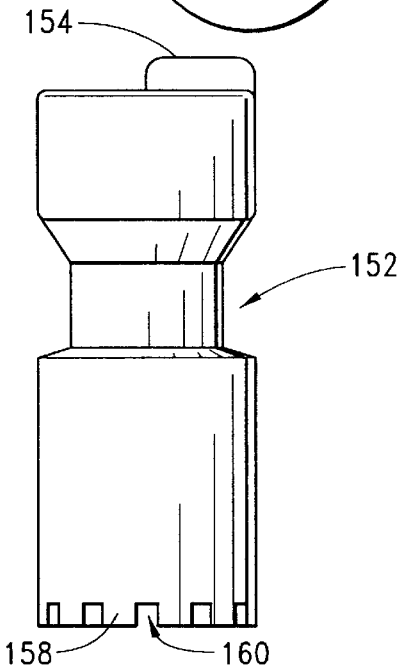
FIG. 11 is an elevational view of the rotary positioner of FIG. 10.
Figure 12:
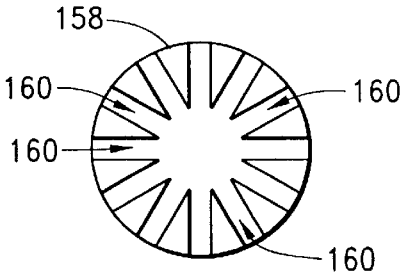
FIG. 12 is a view of the other end of the rotary positioner of FIG. 10.

FIGS. 10 through 12 show a rotational positioning member 152 that is disposed within the cavity 108 of the housing 102 in axial alignment and abutment with the sonde 110. The rotational positioning member 152 has an extending tab 154 that engages a slot (not shown) in one end of the sonde 110 to lockingly secure the rotational position of the rotational member 152 with the sonde 110. A distal end of the sonde 110 pressingly engages a supporting shoulder 156 (FIG. 4) of the housing 102 for free rotation thereagainst. An opposing end 158 of the rotational positioning member 152 has a number of slots 160, each of which is disposable about a projecting tab 162 (FIG. 4) of the housing 102. By aligning a selected one of the slots 160 with the tab 162, the sonde 110 is rotationally positioned as desired and locked in place.

Figure 13:
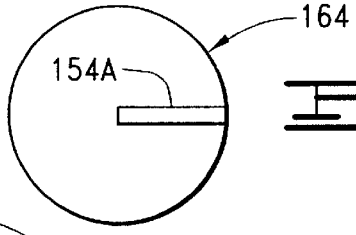
FIG. 13 is a view of another embodiment or a rotary positioner.
Figure 14:
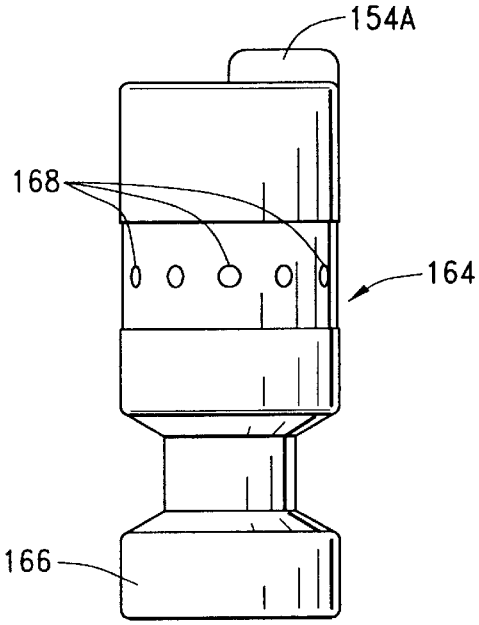
FIG. 14 is an elevational view of the rotary positioner of FIG. 13.
Figure 15:
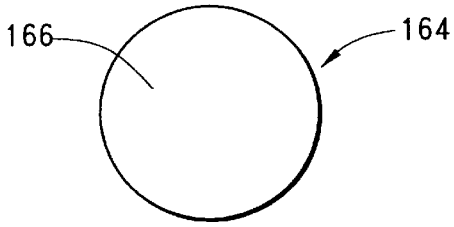
FIG. 15 is a view of the other end of the rotary positioner of FIG. 13.
Figure 15:
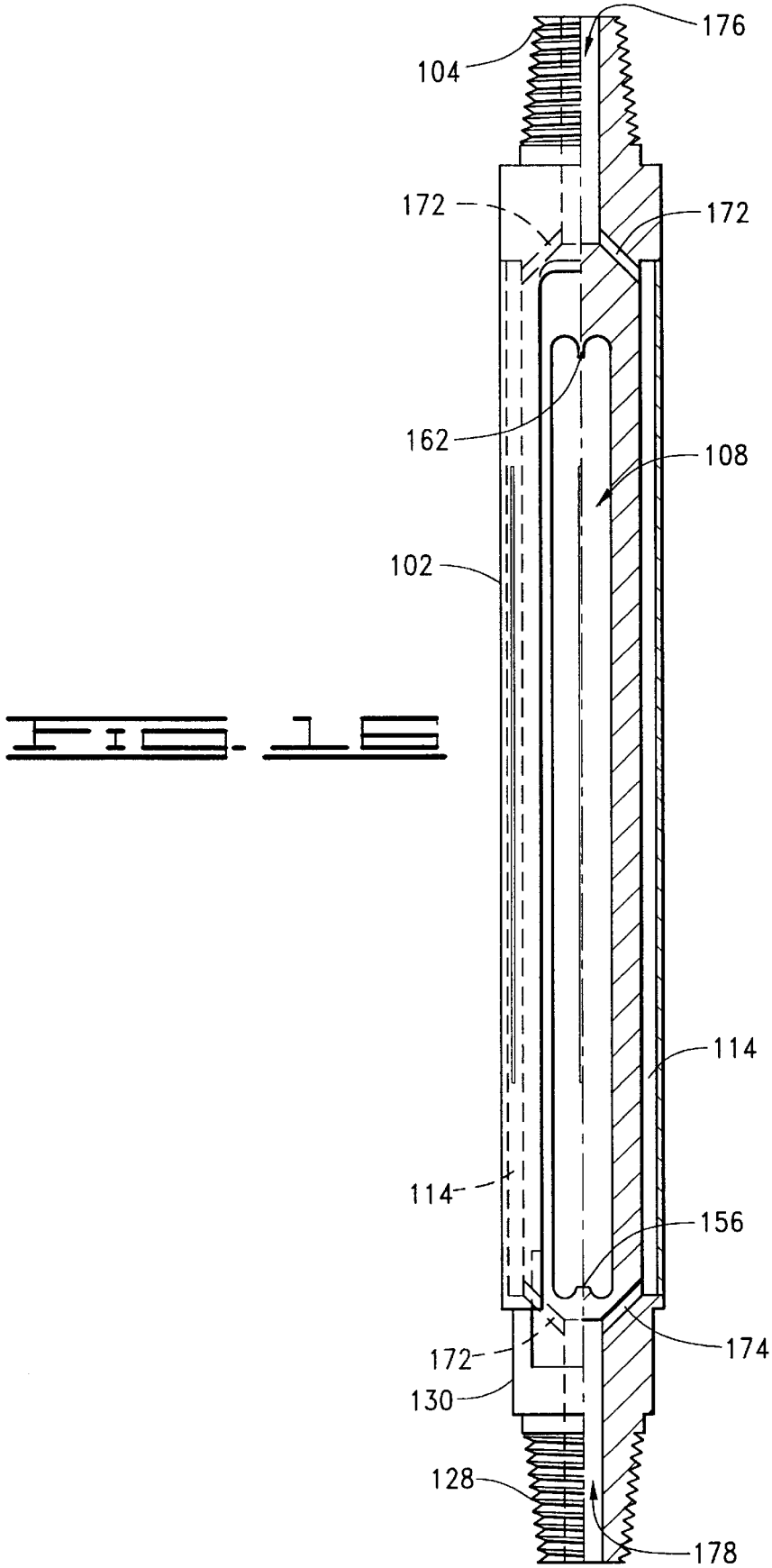

FIGS. 13 through 15 show a rotational positioning member 164 built in accordance with an alternative embodiment of the present invention. In similar manner to the rotational positioning member 152, the rotational positioning member 164 has a tab 154A for lockingly engaging a mating slot (not shown) in one end of the sonde 110, the distal end of the sonde 110 abuttingly engaging and freely rotating against the supporting shoulder 156 of the housing 102 when positioned in the cavity 108. The rotational positioning member 164 has an opposing end 166 that freely rotates against the tab 162 of the housing 102. The rotational positioning member 164 has a plurality of holes 168 extending through a medial portion thereof, and in this embodiment, the sonde 110 and rotational positioning member are together rotated to a desired rotational orientation, and then a stake rod (not shown) is passed through a selected one of the holes 168, a distal end of the stake rod being disposed in an aligning aperture 170 (FIG. 4) appropriately disposed through the housing 102. In this embodiment, the stake rod lockingly engages the rotational positioning member 164 and the housing 102, which rotationally locks the sonde 110 in place.

FIG. 16 is a partial sectional view of the housing 102 and shows a plurality of upper and lower channels 172, 174, respectively, that connect the passageways 114 to upper and lower central bores 176, 178 for passing of drilling fluids therethrough to circulate drilling fluids through the housing 102 to a conventional drilling tool during drilling operations.

In view of the foregoing discussion, it will be understood that the present invention is directed to a transmitter housing (such as 100) having a housing (such as 102) that receivingly supports a sonde (such as 110) and rotationally positions the sonde by a supporting rotational positioning member (such as 152, 164). A locking cover (such as 116) lockingly engages the housing 102 to secure the sonde, the locking cover having upper and lower tabs (such as 148, 150) that slidingly engage receiving detents (such as 132, 138), thus not requiring conventional fasteners to attach the locking cover to the housing. With the locking cover in place, a locking sub (such as 106) threadably engages a lower end of the housing, the locking sub having a counterbore (such as 126) that captures and retains the locking cover to retain the locking engagement of the locking cover within the housing.

It will be clear that the present invention is well adapted to attain the ends and advantages mentioned as well as those inherent therein. While presently preferred embodiments have been described for purposes of this disclosure, numerous changes can be made which will readily suggest themselves to those skilled in the art and which are encompassed in the spirit of the invention disclosed and as defined in the appended claims.

What is claimed is:

1. An apparatus for housing a probe on a directional underground drilling device comprising:

a housing having first and second ends and having a longitudinally extending bore for receiving the probe, wherein the housing comprises a first detent near the first end;

a cover member, slidingly engaging the first detent, for securing the probe within the housing; and a sub that threadably engages the second end of the housing for securing the cover member on the housing.

2. The apparatus of claim 1 wherein the cover member comprises a first tab for engaging the first detent.

3. The apparatus of claim 2 wherein the housing further comprises a second detent near the second end of the housing and a second tab on the cover member for engaging the second detent.

4. The apparatus of claim 3 further comprising:

a positioning member engaging the probe for properly positioning the probe within the housing.

5. The apparatus of claim 4 wherein the housing comprises a projecting tab and wherein the positioning member comprises a plurality of slots for selectively engaging the projecting tab to properly orient the probe.

6. The apparatus of claim 4 wherein the housing comprises an alignment aperture and wherein the positioning member comprises a plurality of holes for selectively aligning the position of the probe within the housing and wherein the apparatus further comprises a pin, engaging the alignment aperture and a selected one of the holes, for securing the orientation of the probe.

7. The apparatus of claim 4 wherein the housing has a passageway for fluid flow.

8. The apparatus of claim 7, wherein the housing is threaded on both the first and second ends.

9. The apparatus of claim 8, wherein the housing has longitudinal slots to transmit signals from the probe.

10. The apparatus of claim 9, wherein the cover member has at least one longitudinal slot to transmit signals from the probe.

11. The apparatus of claim 4 wherein the positioning member has a tab, wherein the probe has a slot, and wherein the positioning member tab engages the slot in the probe.

12. An apparatus for housing a probe on a directional underground drilling device comprising:

a housing having first and second ends and having a longitudinally extending bore for receiving the probe, comprising:

a first detent near the first end; and a second detent near the second end;

a cover member, slidingly engaging the first and second detents, for securing the cover member to the housing;

a positioning member engaging the probe for properly positioning the probe within the housing; and a sub that threadably engages the second end of the housing for securing the probe within the housing.

13. The apparatus of claim 12 wherein the housing comprises a projecting tab and wherein the positioning member comprises a plurality of slots for selectively engaging the projecting tab to properly orient the probe.

14. The apparatus of claim 12 wherein the housing comprises an alignment aperture and wherein the positioning member comprises a plurality of holes for selectively aligning the position of the probe within the housing and wherein the apparatus further comprises a pin, engaging the alignment aperture and a selected one of the holes, for securing the orientation of the probe.

15. The apparatus of claim 12 wherein the housing has a passageway for fluid flow.

16. The apparatus of claim 15, wherein the housing is threaded on both the first and second ends.

17. The apparatus of claim 16, wherein the housing has longitudinal slots to transmit signals from the probe.

18. The apparatus of claim 17, wherein the cover member has at least one longitudinal slot to transmit signals from the probe.

* * * * *